US007784290B2

(12) United States Patent
Shah

(10) Patent No.: US 7,784,290 B2
(45) Date of Patent: Aug. 31, 2010

(54) REFRIGERATION SYSTEMS HAVING DIAGNOSTIC DEVICES

(75) Inventor: Rajendra K Shah, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 700 days.

(21) Appl. No.: 11/655,526

(22) Filed: Jan. 19, 2007

(65) Prior Publication Data

US 2007/0186568 A1 Aug. 16, 2007

Related U.S. Application Data

(60) Provisional application No. 60/760,539, filed on Jan. 20, 2006.

(51) Int. Cl.
*F25B 49/00* (2006.01)
*G01K 13/00* (2006.01)
*G06F 11/30* (2006.01)

(52) U.S. Cl. ..... 62/129; 62/126; 62/127; 702/185

(58) Field of Classification Search ..... 62/129, 62/127, 126; 702/182, 183, 185, 188; 361/78, 361/79, 80
See application file for complete search history.

(56) References Cited

U.S. PATENT DOCUMENTS 3,583,173 A * 6/1971 Chesebro ..... 62/158
6,125,020 A * 9/2000 Oh ..... 361/22

* cited by examiner

*Primary Examiner*—Chen-Wen Jiang
(74) *Attorney, Agent, or Firm*—Cantor Colburn LLP

(57) ABSTRACT

A refrigeration system is provided that includes a low voltage control circuit, a high voltage control circuit, a refrigeration system component, a contactor, a plurality of detection points, and a diagnostic device. The contactor is controlled by the low voltage control circuit to apply supply voltage from the high voltage control circuit to the refrigeration system component. The detection points are serially positioned with respect to one another within the low voltage control circuit and/or the high voltage control circuit. The diagnostic device has a plurality of indicator lights, where each indicator light is in electrical communication with a different one of the plurality of detection points.

23 Claims, 5 Drawing Sheets

20 16-3 16-4 22 16-5

TechAssist Diagnostics-at-a-glance

18

16-1 16-2 16-6

| Control Ladder | | | Power ladder | | | | |
|---|---|---|---|---|---|---|---|
| Green LEDs | | | Amber LEDs | | | | |
| Y | HPS | LPS | 230V | Contactor | Compressor | Indication | Possible Cause & Quick Trouble-Shooting |
| Off | Off | Off | Off | Off | Off | - No 230V power to unit<br>- No thermostat call | - Check 230V disconnect/ circuit breaker<br>- Check wire connections |
| On | Off | Off | -- | Off | Off | HPS Switch Open | - Check pressures<br>- Check HPS wire connections |
| On | On | Off | -- | Off | Off | LPS Switch Open | - Check pressures<br>- Check LPS wire connections |
| On | On | On | Off | Off | Off | No 230V power to unit | - Check 230V disconnect / circuit breaker<br>- Check wire connections |
| On | On | On | On | Off | Off | Contactor open *** | - Check Contactor and replace if necessary<br>- Check wire connections |
| On | On | On | On | On | Off | Compressor not running | - Check for compressor protector trip, capacitor fault, faulty connections or compressor fault. SEE BELOW. |
| On | On | On | On | On | On | Compressor running | OK |
| Off | Off | Off | On | Off | Off | No thermostat call, standby | OK |
| Off | Off | Off | On | On | Off | Contactor stuck closed, compressor tripped | - Check Contactor and replace if necessary<br>- Check wire connections for shorts |
| Off | Off | Off | On | On | On | Contactor stuck closed, compressor running | - Check Contactor and replace if necessary<br>- Check wire connections for shorts |

Note: - Follow arrows to first unlit LED in control (green) ladder or power (amber) ladder to determine problem area.

*** - For contactor LED to be On, all control LEDs (green) as well as 230V LED (amber) must already be on, and contactor must operate properly

Fig. 3

18

| LED | Description | On | Off |
|---|---|---|---|
| Y | Thermostat cooling call | Yes | No |
| HPS | High Pressure Switch | Closed | Open |
| LPS | Low Pressure Switch | Closed | Open |
| 230V | AC Line power available | Yes | No |
| Contactor | Contactor energized | Yes | No |
| Compressor | Compressor running | Yes | No |

16-1 16-2 16-3 16-3 16-4 16-5

Fig. 4

REFRIGERATION SYSTEMS HAVING DIAGNOSTIC DEVICES

CROSS REFERENCE TO RELATED APPLICATIONS

This application claims the benefit of U.S. Provisional Application Ser. No. 60/760,539, filed Jan. 20, 2006, the contents of which are incorporated by reference herein.

BACKGROUND OF THE INVENTION

1. Field of the Invention

The present disclosure relates to refrigeration systems. More specifically, the present disclosure related to refrigeration systems having diagnostic devices and methods of detecting locations of malfunctions in refrigeration systems.

2. Description of Related Art

Refrigeration systems such as air conditioning systems are used in commercial and residential buildings, as well as automobiles, trains, and airplanes and other transportation include. Additionally, refrigeration systems are also commonly used in devices such as refrigerators, chillers, freezers, and ice makers.

Components in a typical residential air conditioning system include a compressor, a condenser coil, an outdoor fan, an expansion device, an evaporator coil, an indoor fan, and a thermostat. In some designs, the compressor, condenser coil, and outdoor fan are enclosed in a cabinet that is located outside of the building, while the evaporator and indoor fan are located inside of the building. The cabinet can include suitable inlet and outlet grills that allow the fan to blow outdoor air over the condenser coil.

In addition to the above and when the refrigerant system is designed to function as a heat pump, the refrigerant system can also include additional components such as a reversing valve for reversing the flow of refrigerant between the condenser and evaporator coils to provide indoor heating instead of cooling. The heat pump can also include a defrost control for removing frost build-up, from the condenser coil, that may have accumulated during heating operation.

A common problem associated with the refrigeration system is, quite simply, a malfunction. When the refrigeration system stops working by failing to deliver any cooling or heating capacity, the room temperature can deviates from desired level, thereby requiring a need for service. A service technician who responds to the service call is subsequently confronted with a vast range of possibilities potentially responsible for the malfunction. Typically, one approach is to check the electrical subsystem to isolate the possible problem area(s). For example, the malfunction may have been caused by a loose electrical connection, a tripped protection switch, a failed contactor, or by an activation of the thermal protector of the compressor—often the thermal protector simply fails to work. Other possibilities include a loss of function by the electrical power source, possibly disconnected at either the air conditioner or at the main electrical circuit breaker panel. Also, the air conditioner operator or homeowner could have inadvertently turned off the thermostat, thereby causing a lack of an operational signal to the air conditioner.

To diagnose the electrical subsystem, a technician considers varied strategies and needs an instrument such as a voltmeter. In addition, the technician must access various points in the electrical circuit to measure the voltage at each point. This access is not always easy because some points may be spliced or connected by twist-on wire connectors without any conveniently exposed terminals. In such situations, the technician must first turn power off, disconnect these electrical points, turn on power to take the appropriate measurements, then turn off the power again to reconnect the points. Moreover, the aforementioned steps require specific training and a clear understanding of the exact electrical circuit configuration specific to each air conditioner and knowledge of the functional order of the various switches and protectors. Without this knowledge, identification of the specific problem causing the malfunction is admittedly difficult.

Therefore, it has been determined by the present disclosure that there is a need for refrigeration systems having indicator systems that overcome, alleviate, and/or mitigate one or more of the aforementioned and other deleterious effects of prior art refrigeration systems.

SUMMARY OF THE INVENTION

A refrigeration system is provided that includes a low voltage control circuit, a high voltage control circuit, a refrigeration system component, a contactor, a plurality of detection points, and a diagnostic device. The contactor is controlled by the low voltage control circuit to apply supply voltage from the high voltage control circuit to the refrigeration system component. The detection points are serially positioned with respect to one another within the low voltage control circuit and/or the high voltage control circuit. The diagnostic device has a plurality of indicator lights, where each indicator light is in electrical communication with a different one of the plurality of detection points.

A refrigeration system is also provided that includes a low voltage control circuit, a high voltage control circuit, and a diagnostic device resident on the refrigeration system. The low voltage control circuit serially connects a low voltage source to a contactor coil through a thermostat, a high pressure switch, and a low pressure switch. Similarly, the high voltage control circuit serially connects a high voltage power source to a refrigeration system component through a contactor contact, a thermal overload protector, and a capacitor. The diagnostic device is resident on the refrigeration system and detects a location of a malfunction in the low voltage control circuit and/or the high voltage control circuit.

A method of detecting a location of a malfunction in a refrigeration system is provided. The method includes applying voltage to a plurality of indicator lights each in respective electrical communication with a plurality of detection points in a low voltage control circuit and a high voltage control circuit so that voltage in the high and low voltage control circuits is applied to the indicator light when the voltage is present at the detection point; determining which one of the plurality of indicator lights is a first one of the plurality of indicator lights to be in an off state; and associating the first one to a known location of the detection point in electrical communication with the first one.

The above-described and other features and advantages of the present disclosure will be appreciated and understood by those skilled in the art from the following detailed description, drawings, and appended claims.

BRIEF DESCRIPTION OF THE DRAWINGS

FIG. 3 illustrates an exemplary embodiment of a diagnostic matrix according to the present disclosure for use with the indicator panel of FIG. 2;

FIG. 4 illustrates an alternate exemplary embodiment of a diagnostic matrix according to the present disclosure for use with the indicator panel of FIG. 2.

DETAILED DESCRIPTION OF THE INVENTION

Figure 1:
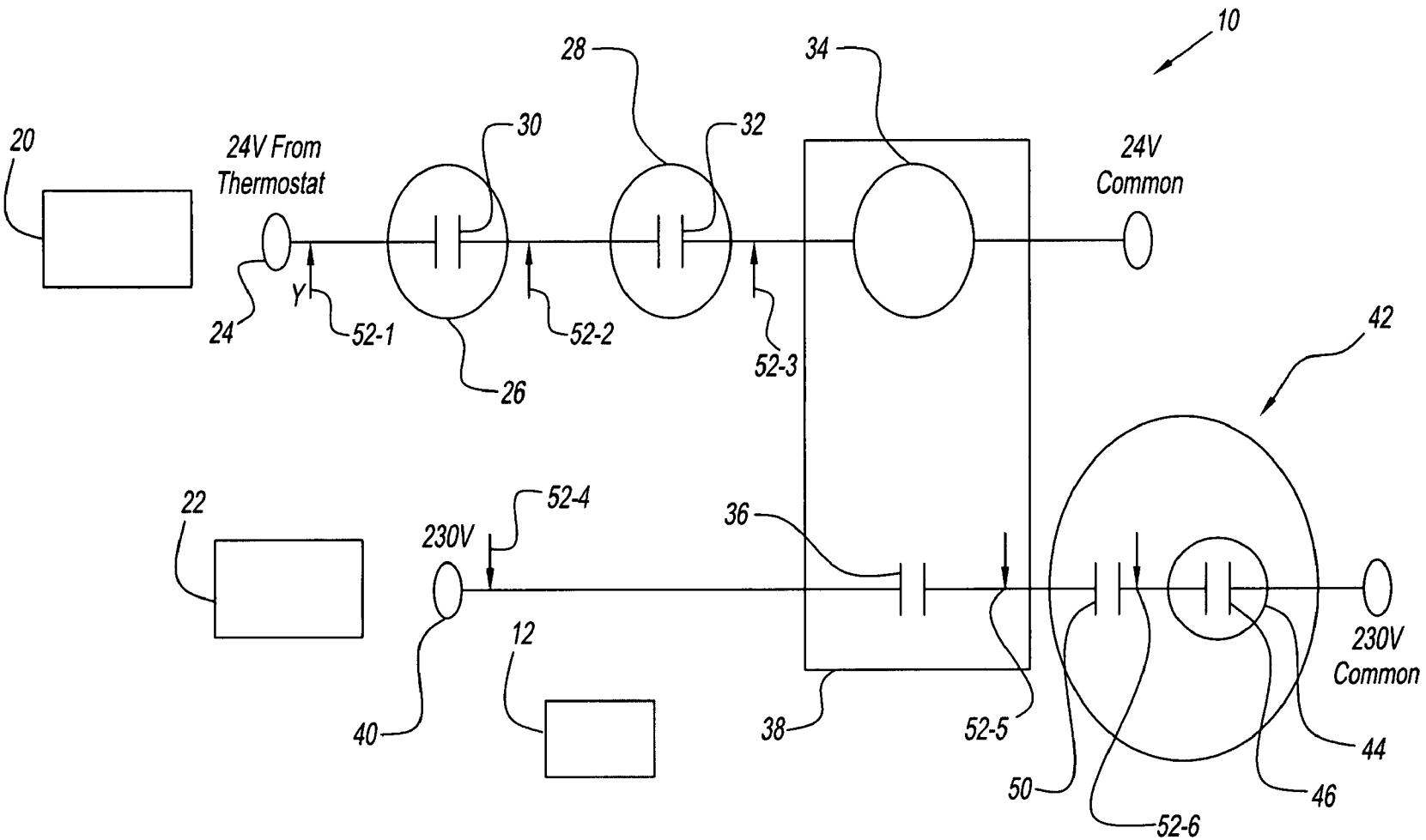
FIG. 1 is a schematic illustration of a refrigeration system having an exemplary embodiment of a diagnostic device according to the present disclosure.
Figure 2:
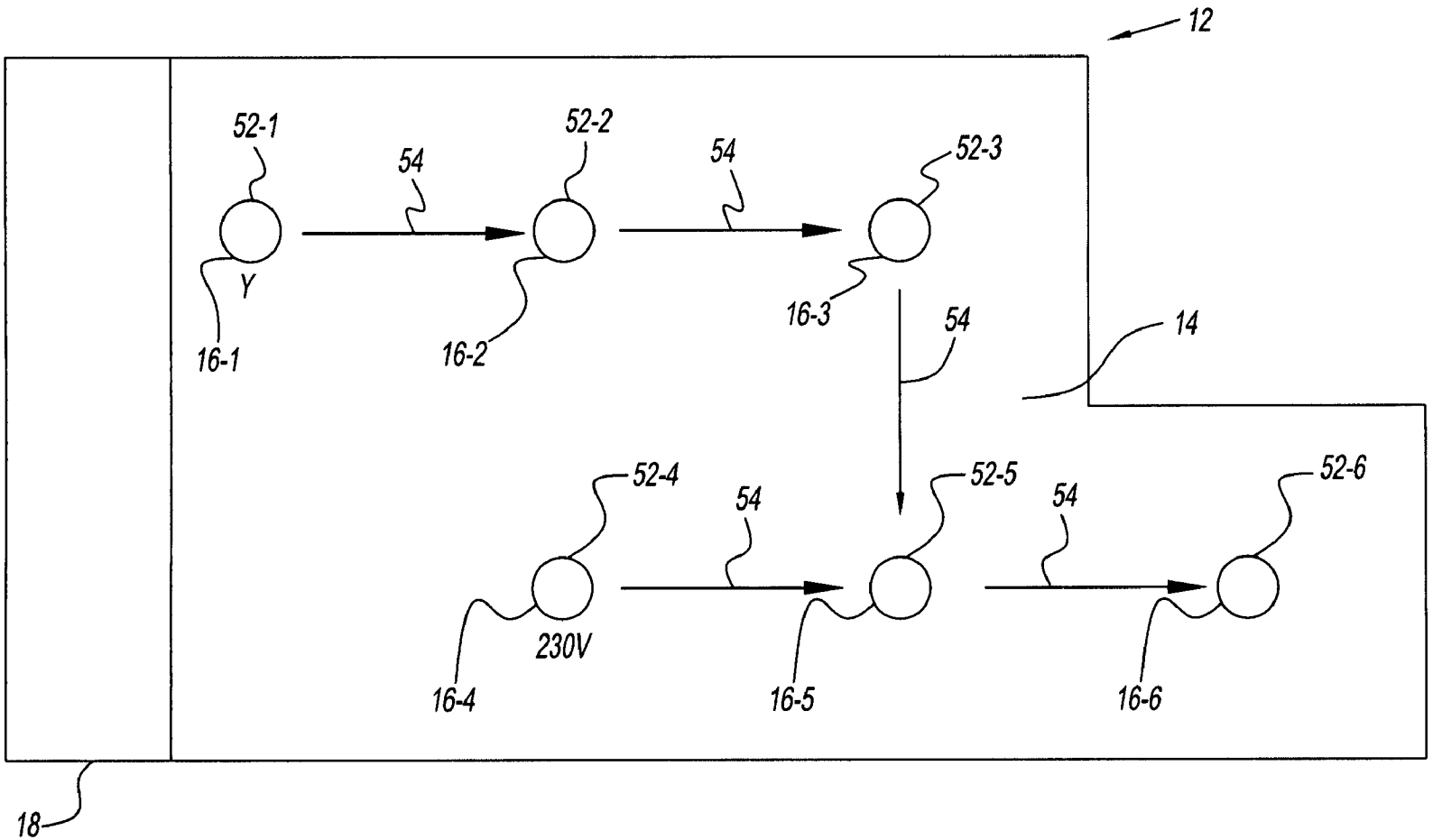
FIG. 2 is an illustration of an exemplary embodiment of an indicator panel of the diagnostic device of FIG. 1.

Referring now to the figures, and in particular to FIGS. 1 and 2, an exemplary embodiment of a refrigeration system according to the present disclosure is shown and is generally referred to by reference numeral 10. Refrigeration system 10 can be an air conditioner, a heat pump, a refrigerator, a freezer, and any other known system. For purposes of clarity, refrigeration system 10 is shown as an air conditioner.

Refrigeration system 10 includes a diagnostic device 12. As shown in FIG. 2, diagnostic device 12 includes an indicator panel 14 having a plurality of indicator lights 16 disposed thereon. Indicator lights 16 are configured to provide a status indication of particular points within the electrical subsystem of system 10 based on the state (e.g., on or off) of the lights. Indicator lights 16 correspond to control points within the control circuits of refrigeration system 10.

Thus, refrigeration system 10 having diagnostic device 12 includes a diagnostic "tool" right within the electrical subsystem of the refrigeration system that enables a technician to quickly and correctly narrow the problem area. Further, diagnostic device 12 provides a diagnostic capability at low cost and without the need for complex testing or electronic devices such as microprocessors.

Accordingly, diagnostic device 12 eliminates the need to disconnect any wiring to gain access to measurement points and eliminates the need for the technician to have a voltmeter or similar instrument to locate potential fault areas. Further, diagnostic device 12 allowing experienced technicians to simply glance at the diagnostic device and immediately determine the problem area.

Moreover, diagnostic device 12 allows non-experienced technicians or novices, with little instruction, to more accurately diagnose the location of potential problem areas. For example, diagnostic device 12 can include diagnostic matrix 18 within sight of indicator panel 14. Diagnostic matrix 18 can include simple directions to guide the non-experienced technicians or novices in comparing the state of indicator lights 16 to matrix 18 to diagnose potential malfunctions.

Refrigeration system 10 includes a low voltage control circuit or ladder 20 and a high voltage control circuit or ladder 22. Low voltage control circuit 20 includes a control voltage Y (e.g., 24-volts) transmitted from a thermostat 24 to refrigeration system 10. Thermostat 24 is typically mounted on an interior wall of the home or building where the operator can set a desired room temperature. The control voltage Y is controlled by thermostat 24 and is switched on or off when a signal from the thermostat commands cooling operation. When thermostat 24 detects a need for cooling, the thermostat applies control voltage Y to circuit 20. Conversely, thermostat 24 detects that the need for cooling is no longer present, the thermostat removes control voltage Y from circuit 20.

Low voltage control circuit 20 also includes a high-pressure switch (HPS) 26 and a low pressure switch (LPS) 28. High-pressure switch 26 includes selectively openable contacts 30. Similarly, low-pressure switch 28 includes selectively openable contacts 32. Low voltage control circuit 20 is configured so that control voltage Y is in-series with switches 26, 28 and a coil 34. In this manner, the control voltage Y is applied to coil 34 through switches 26, 28 when contacts 30, 32 are closed.

When the control voltage Y is applied to coil 34, the coil closes selectively openable contacts 36 of high voltage control circuit 22. Coil 34 and contacts 36 can be arranged in a contactor device 38.

Contacts 36, when closed, apply voltage from a voltage source 40 (e.g., 230 volts and/or 110 volts) to one or more components of refrigerant system 10. In the illustrated embodiment, contacts 36 are illustrated applying voltage from voltage source 40 to a compressor 42. Of course, it is contemplated by the present disclosure for contacts 36 to apply voltage to other components of refrigerant system 10 such as, but not limited to, an indoor fan, an outdoor fan, an expansion device, and others.

In some embodiments, compressor 42 can include a motor capacitor 44 having selectively openable contacts 46 and a thermal protection switch 48 having selectively openable contacts 50. Thermal protection switch 48 is configured to opens contacts 50 to cut off power to compressor 42 if the compressor overheats.

High voltage control circuit 22 is configured so that voltage from voltage source 40 is in-series with contacts 36, 46, and 50. In this manner, the voltage is applied from voltage source 40 to compressor 42 when contacts 36, 46, and 50 are all closed.

Advantageously, diagnostic device 12 places a plurality of detection points 52 in electrical communication with indicator lights 16. In the illustrated embodiment, diagnostic device 12 includes six detection points 52-1, 52-2, 52-3, 52-4, 52-5, and 52-6 and six indicator lights 16-1, 16-2,16-3,16-4, 16-5, and 16-6. Here, the first detection point 52-1 is in electrical communication with the first indicator light 16-1, the second detection point 52-2 is in electrical communication with the second indicator light 16-2, and so on so that each detection point 52 is in electrical communication with a different indicator light 16.

In addition, each detection point 52 is representative of a location where the presence or absence of voltage can be measured and can be indicative of a fault in a particular location within refrigeration system 10.

In the illustrated embodiment, the first detection point 52-1 is indicative of whether control voltage Y is being applied to low voltage control circuit 20 by thermostat 24. The second detection point 52-2 is indicative of whether contacts 30 of high pressure switch 26 are closed such that control voltage Y is transmitted through the high pressure switch. The third detection point 52-3 is indicative of whether contacts 32 of low pressure switch 28 are closed such that control voltage Y is transmitted through the high pressure switch to coil 34. The fourth detection point 52-4 is indicative of whether voltage from voltage source 40 is being applied to high voltage control circuit 22. The fifth detection point 52-5 is indicative of whether contacts 36 of contactor 38 are closed such that voltage is transmitted through the contactor to compressor 42. The sixth detection point 52-6 is indicative of whether contacts 50 of thermal protection switch 48 are closed such that voltage is transmitted through the switch to motor 44.

As noted in the background above, these voltages could be measured with an instrument such as a voltmeter. However, such a measurement with a voltage meter is difficult, if not impossible. Advantageously, diagnostic device 12 eliminates the need for such a meter, as well as the time and cost associated with measurements using such a meter.

Furthermore, sixth detection point 52-6 is physically located within compressor 42 and is inaccessible by such a meter. In some embodiments of the present disclosure, compressor 42 can be wired so as to place sixth detection point 52-6 in electrical communication with sixth indicator light 16-6. In other embodiments, compressor can include an externally run capacitor (not shown) to provide the electrical communication between the sixth detection point 52-6 and the sixth indicator light 16-6.

It is contemplated by the present disclosure for detection points 52 to be in electrical communication with indicator lights 16 via a wired connection therebetween and/or a wireless connection therebetween.

In this manner, each indicator light 16 can visually identify the presence or absence of voltage at one particular detection point 52. In some embodiments, indicator lights are positioned on indicator panel 14 so that the lights form an ordered array of indicator lights, where the order of the lights are representative of the position of the respective detection point in the low and high voltage control circuits, respectively. In other embodiments, indicator panel 14 can include directional arrows 54 between indicator lights 16 to show the step by step flow of control voltage or supply voltage in the circuits 20, 22.

In sum, refrigeration system 10 includes low voltage control circuit 20 and high voltage power circuit 22, each of which includes a plurality of serially wired switches or contacts that perform a variety of functions. For example, when the contacts of each switch are closed, that switch sends power on to the next successive switch in the serially wired circuit. When all of the switches along the circuits are activated (i.e., contacts are closed), power is delivered to the components of refrigeration system 10. In contrast, if any individual switch is deactivated (i.e., contacts are open), a "break" in the circuit results such that voltage is no longer applied to any successive switch in the circuit. Diagnostic device 12 is configured to identifying the step or location in either circuit 20, 22 where this break has occurred to assist the technician in pinpointing the location and, possibly the source of the malfunction.

The ordered array of indicator lights 16 on indicator panel 14 can be used by a service technician to—at a glance—easily identify and isolate an area of refrigeration system 10 without voltage, which provides an indication of the location of the malfunction.

In one embodiment, diagnostic device 12 is configured so that the malfunction would correspond to the first indicator light 16 that is off. Of course, it is contemplated by the present disclosure for diagnostic device 12 to be configured so that the malfunction would correspond to the first indicator light 16 that is on.

In the embodiment where diagnostic device 12 is configured so that the malfunction corresponds to the first indicator light 16 that is off, when the indicator light 16-1 is off, a service technician would be alerted that thermostat 24 is not applying control voltage Y to low voltage control circuit 20 and, hence is not "commanding" a cooling operation. Here, all other indicator lights 16 down stream of the first indicator light 16-1 would also be off. More specifically, indicator light 16-4 would be on if power source 40 is applying voltage to high voltage control circuit 22, while all other lights would be off.

In contrast, if the first indicator light 16-1 is on, but the second indicator light 16-2 is off, this pattern indicates that any malfunction could be attributable to the high-pressure switch 26. Moreover, if the first and second indicator lights 16-1, 16-2 are both illuminated, but the third indicator light 16-3 is off, then the malfunction can be localized to low pressure switch 28.

In still other embodiments, diagnostic device 12 can be configured for electrical communication external to system 10. For example, it is contemplated by the present disclosure for diagnostic device 12 to be configured for communication with a technician via the Internet.

To assist with trouble shooting using indicator lights 16, diagnostic device 12 can include diagnostic matrix 18, examples of different embodiments of which are illustrated in FIGS. 3 and 4.

Indicator lights 16 can be any illumination device such as, but not limited to, incandescent light bulbs, fluorescent light bulbs, light emitting diodes, and others. Diagnostic device 12 is configured such that indicator lights 16 receiving voltage from low voltage control circuit 20 and the indicator lights 16 receiving voltage from high voltage control circuit 22 are illuminated as desired. For example, indicator lights 16 powered by low voltage control circuit 20 can be suitable for illumination by low voltage (24 volts AC), while indicator lights 16 powered by high voltage control circuit 22 can be suitable for illumination by high voltage (230 volts AC).

Figure 5:
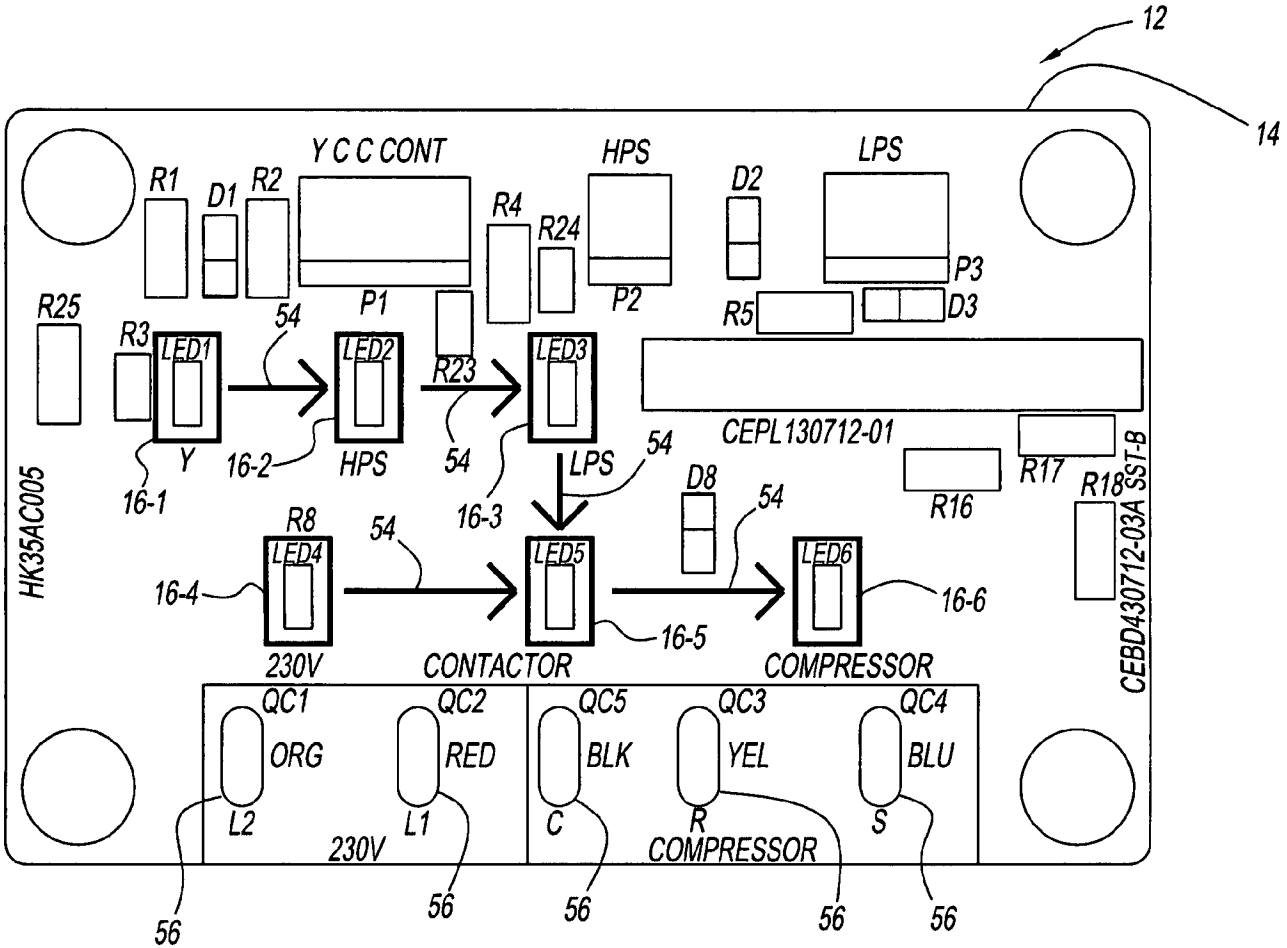
FIG. 5 is an illustration of an alternate exemplary embodiment of an indicator panel having wired connections thereon.

Referring now to FIG. 5, an alternate exemplary embodiment of diagnostic device 12 is shown. Here, diagnostic device 12 includes in addition to indicator lights 16, a plurality of wire terminals 56. Wire terminals 56 provide contact points for measuring voltage at each detection point 52 of refrigeration system 10.

Therefore, the present disclosure provides refrigeration system 10 with diagnostic device 12 for diagnosing a malfunction in the refrigeration system by placing detection points 52 between serially wired locations in the low and high voltage control circuits 20, 22. The detection points 52 apply the voltage at each point to indicator lights 16 on indicator panel 14.

In use, diagnostic device 12 provides a method of determining a malfunction in refrigeration system 10. The method includes the steps of: applying a voltage from a plurality of detection points 52 within the low voltage control circuit 20 and/or high voltage power circuit 22 to a plurality of indicator lights and associating the state of the indicator lights to the cause of the malfunction in the system.

The prior art diagnostic process for a malfunctioning refrigeration system can be very time consuming and is often prone to error. The misdiagnosis of a failed system can also be costly. For example, a service technician who wrongly identifies (and replaces) the source of the problem as a compressor, may later realize that the real problem was in fact a comparatively lower cost device such as a contactor. Advantageously, diagnostic device 12 eliminates and/or mitigates these issues present in the prior art refrigeration systems 10.

It should be recognized that refrigeration system 10 is described herein by way of example having six indicator lights and six detection points. Of course, it is contemplated by the present disclosure for system 10 to include more or less than six lights and points. For example, it is contemplated for system 10 to include as few as two and as many as twenty sets of indicator lights and detection points.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A refrigeration system comprising:

a low voltage control circuit; a high voltage control circuit;

a refrigeration system component;

a contactor controlled by said low voltage control circuit to apply supply voltage from said high voltage control circuit to said refrigeration system component;

a plurality of detection points serially positioned with respect to one another within said low voltage control circuit and/or said high voltage control circuit; and a diagnostic device having a plurality of indicator lights, each indicator light being in electrical communication with a different one of said plurality of detection points.

2. The refrigeration system of claim 1, wherein said low voltage control circuit comprises a thermostat, a high pressure switch, a low pressure switch, and a contactor coil serially wired to one another so that said low voltage control circuit applies a control voltage to said contactor coil if said thermostat, said high pressure switch, and said low pressure switch are activated.

3. The refrigeration system of claim 2, wherein said high voltage control circuit comprises a power source and a contactor contact serially wired to one another so that said high voltage control circuit applies a supply voltage to said refrigeration system component if said power source and said contactor contact are activated.

4. The refrigeration system of claim 3, wherein said contact coil activates said contactor contact when said control voltage is applied to said contact coil.

5. The refrigeration system of claim 4, wherein said plurality of indicator lights comprise an ordered array of said indicator lights, each light corresponding to said different one of said plurality of detection points.

6. The refrigeration system of claim 5, wherein said ordered array comprises an order that corresponds to a direction flow of said control voltage and/or said supply voltage.

7. The refrigeration system of claim 3, wherein said diagnostic device further comprises a directional arrow between each of said plurality of indicator lights, said directional arrows corresponding to a direction flow of said control voltage and/or said supply voltage.

8. The refrigeration system of claim 1, wherein said diagnostic device further comprises a plurality of wire terminals, said plurality of wire terminals providing a contact point for measuring voltage at each of said detection points.

9. The refrigeration system of claim 1, wherein said refrigeration system component comprises a compressor.

10. The refrigeration system of claim 9, wherein said compressor comprises a motor capacitor contact and a thermal protection contact.

11. The refrigeration system of claim 1, wherein the refrigeration system finds use as an air conditioner, a heat pump, a refrigerator, or a freezer.

12. The refrigeration system of claim 1, wherein each of said indicator lights is in electrical communication with a different one of said plurality of detection points via a wired connection and/or a wireless connection.

13. The refrigeration system of claim 1, wherein said diagnostic device is configured for electrical communication with the Internet.

14. A refrigeration system comprising:

a low voltage control circuit serially connects a low voltage source to a contactor coil through a thermostat, a high pressure switch, and a low pressure switch;

a high voltage control circuit serially connects a high voltage power source to a refrigeration system component through a contactor contact, a thermal overload protector, and a capacitor; and a diagnostic device resident on the refrigeration system to detect a location of a malfunction in said low voltage control circuit and/or said high voltage control circuit;

wherein said diagnostic system comprises a plurality of indicator lights, each indicator light being in electrical communication with a respective detection point in said low and high voltage control circuits so that voltage in said high and low voltage control circuits is applied to said indicator light when said voltage is present at said detection point.

15. The refrigeration system of claim 14, wherein said diagnostic device further comprises a directional arrow between each of said plurality of indicator lights, said directional arrows corresponding to a direction flow of said voltage.

16. The refrigeration system of claim 15, wherein said location of said malfunction corresponds to a first indicator light of said plurality of indicator lights that is off.

17. The refrigeration system of claim 14, wherein said diagnostic device further comprises a plurality of wire terminals, said plurality of wire terminals providing a contact point for measuring said voltage at each of said detection points.

18. The refrigeration system of claim 14, wherein the refrigeration system finds use as an air conditioner, a heat pump, a refrigerator, or a freezer.

19. A method of detecting a location of a malfunction in a refrigeration system, comprising:

applying voltage to a plurality of indicator lights each in respective electrical communication with a plurality of detection points in a low voltage control circuit and a high voltage control circuit so that voltage in said high and low voltage control circuits is applied to said indicator light when said voltage is present at said detection point;

determining which one of said plurality of indicator lights is a first one of said plurality of indicator lights to be in an off state; and associating said first one to a known location of said detection point in electrical communication with said first one.

20. A diagnostic device comprising:

A plurality of indicator lights, each indicator light being configured for electrical communication with a different one of a plurality of detection points in a serially wired electrical system so that each indicator light corresponds to the different one of the plurality of detection points, wherein said plurality of indicator lights are arranged in an ordered array so that an order of said plurality of indicator lights corresponds to a direction flow of voltage through the serially wired electrical system.

21. The diagnostic device of claim 20, further comprising a directional arrow between each of said plurality of indicator lights, said directional arrows corresponding to said direction flow of said voltage.

22. The diagnostic device of claim 20, further comprising a plurality of wire terminals, said plurality of wire terminals providing a contact point for measuring voltage at each of the detection points.

23. The diagnostic device of claim 20, wherein the diagnostic device is configured for electrical communication with the Internet.

* * * * *